US005837955A

United States Patent [19]

Utsumi et al.

[11] Patent Number: 5,837,955

[45] Date of Patent: Nov. 17, 1998

[54] GAS CIRCUIT BREAKER

[75] Inventors: Tomoaki Utsumi, Hitachi; Jun Nukaga, Tomobe-machi; Youichi Ohshita, Hitachinaka; Goro Daimon, Hitachi; Kenji Tsuchiya, Hitachi; Hiroshi Yoshimoto, Hitachi, all of Japan

[73] Assignee: Hitachi, Ltd., Tokyo, Japan

[21] Appl. No.: 781,187

[22] Filed: Jan. 10, 1997

[30] Foreign Application Priority Data

Feb. 9, 1996 [JP] Japan ..... 8-023956

[51] Int. Cl.[6] ..... H01H 33/70

[52] U.S. Cl. ..... 218/77

[58] Field of Search ..... 218/43, 46, 48, 218/56–60, 63, 65, 68, 72, 74, 76, 77, 81, 89, 143–147, 155, 156, 158

[56] References Cited

U.S. PATENT DOCUMENTS

| | | | |
|---|---|---|---|
| 4,403,125 | 9/1983 | Yamaoka et al. | 200/144 R |
| 4,791,256 | 12/1988 | Yonezawa et al. | 200/148 R |
| 5,039,831 | 8/1991 | Sato et al. | 200/144 AP |
| 5,231,256 | 7/1993 | Yamagiwa et al. | 200/148 A |
| 5,347,097 | 9/1994 | Bolongeat-Mobleu et al. | 200/148 B |

FOREIGN PATENT DOCUMENTS

| | | | |
|---|---|---|---|
| 52-121651 | 10/1977 | Japan | C08J 3/24 |
| 62-141909 | 6/1987 | Japan | H02B 13/06 |

*Primary Examiner*—Michael L. Gellner
*Assistant Examiner*—Michael A. Friedhofer
*Attorney, Agent, or Firm*—Fay, Sharpe, Beall, Fagan, Minnich & McKee

[57] ABSTRACT

The gas circuit breaker comprises a metal container filled with an insulating gas; first and second contacts disposed opposite each other in the metal container so that they can be brought into and out of engagement with each other; and a metal shield arranged in the metal container to enclose the two contacts. A part or a whole of the surface of the shield is oxidized and covered with a fluororesin layer. The gas circuit breaker with this construction can protect the shield surface against flaking and scores when subjected to mechanical impacts and can maintain high dielectric strength without increasing the size of the circuit breaker.

8 Claims, 6 Drawing Sheets

GAS CIRCUIT BREAKER

BACKGROUND OF THE INVENTION

The present invention relates to improvements of a gas circuit breaker and more particularly to a gas circuit breaker having an insulation gas sealed in a metal container and incorporating a metal shield.

Commonly used gas circuit breakers of this kind has an interrupter section, i.e., a stationary contact and a movable contact in a metal container which is sealed with an insulation gsa such as $SF_6$ (sulfur hexafluoride). In this kind of gas circuit breaker, the stationary contact and the movable contact are generally enclosed by a shield whose surface is covered with a heat resistant protective coat, as described in Japan Utility Model Laid-Open No. 121651/1977, for example.

That is, the heat-resistant protective coating serves to protect the shield surface from being roughened by hot gases produced at time of interruption and thereby prevent a reduction in dielectric strength of the gas circuit breaker. The heat-resistant protective coating is formed generally by vapor deposition of ceramics such as alumina, or anodization of an aluminum shield, as described in Japan Patent Laid-Open No. 141909/1987.

PROBLEMS TO BE SOLVED BY THE INVENTION

In the conventional gas circuit breaker of the above construction, the shield surface is protected against being roughened by hot gases because of the oxide layer formed over the surface of the shield. However, there are no sufficient considerations taken in terms of mechanical impacts on the shield surface during the assembly of the circuit breaker or damages to the shield surface caused by decomposed $SF_6$ gases produced as a result of an interruption of large current. The coating easily flakes off by mechanical impacts applied to the surface of the shield during assembly and, during many years of service, fine scores are formed on the surface, which will deteriorate the dielectric strength of the gas circuit breaker.

To deal with this problem it is conceivable to reduce the electric field of the shield and increase its dielectric strength. Reducing the electric field of the shield, however, requires increasing the diameter of the shield and results in the distance between the stationary contact and the movable contact becoming large, leading to an increased size and cost.

SUMMARY OF THE INVENTION

It is an object of the present invention to provide a gas circuit breaker of the kind mentioned above which can maintain high dielectric strength without increasing the size of the gas circuit breaker and which is hardly peeled off or damaged even when the shield is subjected to mechanical impacts.

In other words, in a gas circuit breaker which includes a metal container filled with an insulating gas, first and second contacts installed in the metal container so that they can be brought into and out of contact with each other, and a metal shield member arranged to enclose the two contacts; the surface of the shield member is partly or entirely oxidized and covered with a fluororesin layer to achieve the above objective.

The oxide layer is formed by anodization. The fluororesin layer contains boron nitride. The oxide layer has a thickness of 10 $\mu$m to 100 $\mu$m.

Because the shield surface is oxidized and covered with a fluororesin layer, the shield surface is protected from fine scars that would otherwise tend to be formed, and the release of electrons from the shield surface is restricted to maintain adequate dielectric strength. This enables the circuit breaker to retain high dielectric strength without increasing the size of the gas circuit breaker and to prevent the shield from being peeled off or damaged even when the shield is subjected to mechanical impacts. As a result, the gas circuit breaker can be reduced in size and cost.

DESCRIPTION OF THE PREFERRED EMBODIMENTS

Figure 1:
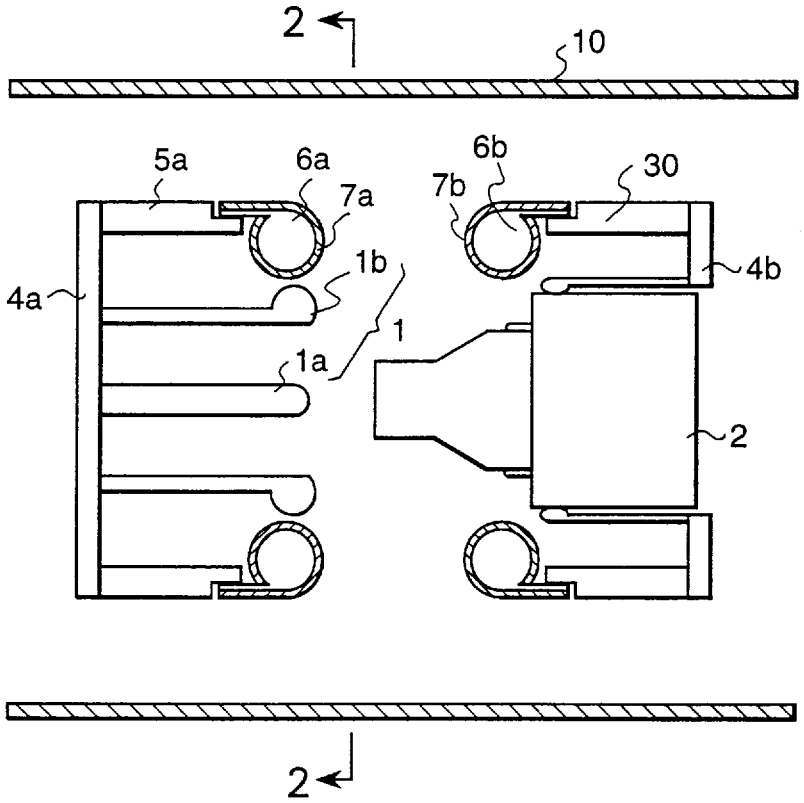
FIG. 1 is a longitudinal cross section of one embodiment of the gas circuit breaker of this invention.
Figure 2:
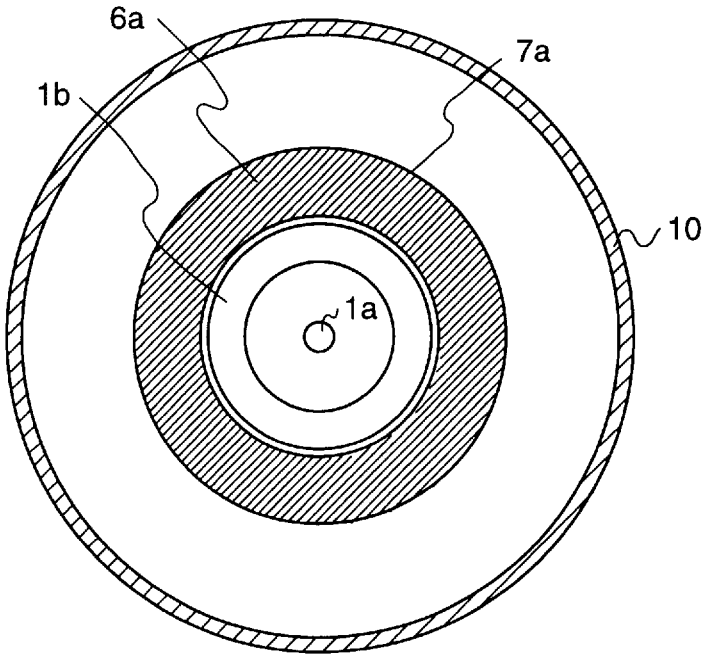
FIG. 2 is a cross section taken along the line A–A' of FIG. 1

The present invention will be described in detail in connection with preferred embodiments shown in the accompanying drawings. FIGS. 1 and 2 show a representative gas circuit breaker in cross section. The gas circuit breaker in cross section. The gas circuit breaker has an enclosed cylindrical metal container 10, in almost the central part of which is installed an interrupter section that comprises a stationary first contact 1 and a slidable second contact 2. The metal container 10 is filled with $SF_6$ gas, which has excellent arc extinction and insulation performances. In the following, the stationary first contact is referred to as a stationary contact 1 and the slidable second contact as a movable contact 2.

The stationary contact 1 includes an arc contact 1*a* and a main contact 1*b*. The movable contact 2 also has an arc contact and a main contact. In a closed state, the arc contacts of the stationary contact 1 and the movable contact 2 are engaged and the main contacts of the stationary contact 1 and the movable contact 2 are engaged. The stationary contact 1 is secured and electrically connected to a conductor 4*a*. The movable contact 2 is also electrically connected to a conductor 4*b*. Because it is slidable, the movable contact 2 is applied an external force from outside the metal container 10 through an insulated operation rod not shown to perform the opening and closing operations.

In this embodiment, shields 5*a*, 6*a* enclose the stationary contact 1 and shields 5*b*, 6*b* enclose the movable contact 2.

The shields 6*a*, 6*b* are made of aluminum and their surfaces are oxidized entirely or partly to form oxide layers 7*a*, 7*b* thereon. These oxide layers are then coated with fluororesin layers 17*a*, 17*b*.

The oxide layer formed on the shield surface and the fluororesin layer formed on the oxide layer improve the pole-to-pole dielectric strength in the open state between the stationary contact 1 and the movable contact 2 and also the dielectric strength between the stationary contact 1 and the ground and between the movable contact 2 and the ground even when the circuit breaker is place in many years of service. This in turn allows the size of the gas circuit breaker to be reduced.

Figure 3:
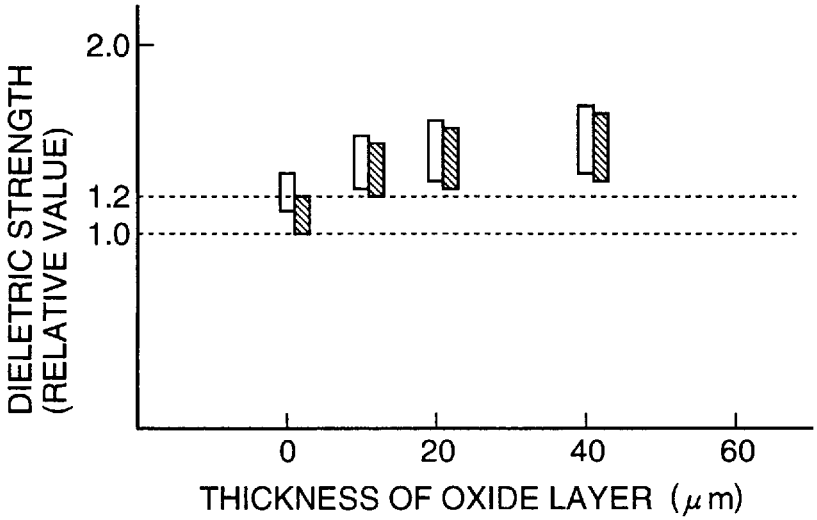
FIG. 3 is a characteristic diagram showing the relation between the thickness of an oxide layer on the shield and the dielectric strength of the shield.

Now, theoretical explanation will be given as to how the dielectric strength of the shield surface of the above structure is improved. FIG. 3 is a characteristic diagram showing the relation between the thickness of an oxide layer and the dielectric strength of an aluminum shield when the aluminum shield is subjected to anodization to form the oxide layer thereon, which is further coated with a fluororesin layer containing boron nitride. Aluminum is suited for the shield material as it is light in weight and is easily drawn. The anodization of aluminum is widely practiced in the materials for construction and is normally called an alumite treatment.

In FIG. 3, blank bars represent the dielectric strength after the circuit breaker is assembled and shaded bars represent the dielectric strength after several interruptions were performed. When such as anode oxidation is not carried out, because the shield is exposed to decomposed gases of $SF_6$ at time of current interruption, the dielectric strength decreases after interruptions. When such a surface layer is formed, the dielectric strength hardly decreases. This diagram shows that the greater the thickness of the oxide layer, the higher the insulation resistance tends to become and that when the oxide layer thickness is set to more than 10 $\mu$m, the dielectric strength is more than 20% higher than when the oxide layer is not formed. It is also noted, however, that when the oxide layer exceeds 10 $\mu$m, the dielectric strength hardly exhibits a corresponding increase.

This is because the release of electrons from electrodes is suppressed by the oxide layer and the fluororesin layer and because the electron suppression effect becomes saturated when the oxide layer is 10 $\mu$m or more. In the normal anode oxidation, the oxide layer is formed to a thickness of less than 100 $\mu$m for the convenience of processing and it is therefore appropriate to set the thickness of the oxide layer in the range of 10 $\mu$m to 100 $\mu$m.

The anodized layer and the fluororesin layer protect the shield surface against cracking and flaking when subjected to external impacts of moderate intensities. The shield surface covered with this combination of protective layers is not easily scarred even after many years of open-close operations, so that there is no possibility of the dielectric strength of the gas circuit breaker deteriorating. Therefore, the dielectric strength after performing interruptions exhibits almost no degradation from the level observed after assembly.

Next, the size reduction of the gas circuit breaker realized by the improved dielectric strength of the shield will be explained by referring to FIG. 1. The shields 6*a*, 6*b* reduce the electric fields of four contacts—the arc contact 1*a* and main contact 1*b* of the stationary contact 1 and the arc contact and main contact of the movable contact 2—and thereby improve the dielectric strength between the open electrodes. As the distance between the shields 6*a* and 6*b* is reduced, it is possible to increase the dielectric strength between the pole-to-pole distance and therefore the stroke.

If the shields 6*a* and 6*b* are placed too close to each other, the electric field of the front ends of the shields increases lowering the dielectric strength between the shields, so there is a limit to the reduction of the distance between the shields 6*a* and 6*b*. As the dielectric strength of the shields improves, the distance between the shields 6*a* and 6*b* can be shortened, making it possible to reduce the pole-to-pole distance and the interruption stroke. As a result, the interrupter section can be reduce in size. Further, the reduced stroke allows the operation device to be reduced in size and cost.

Figure 4:
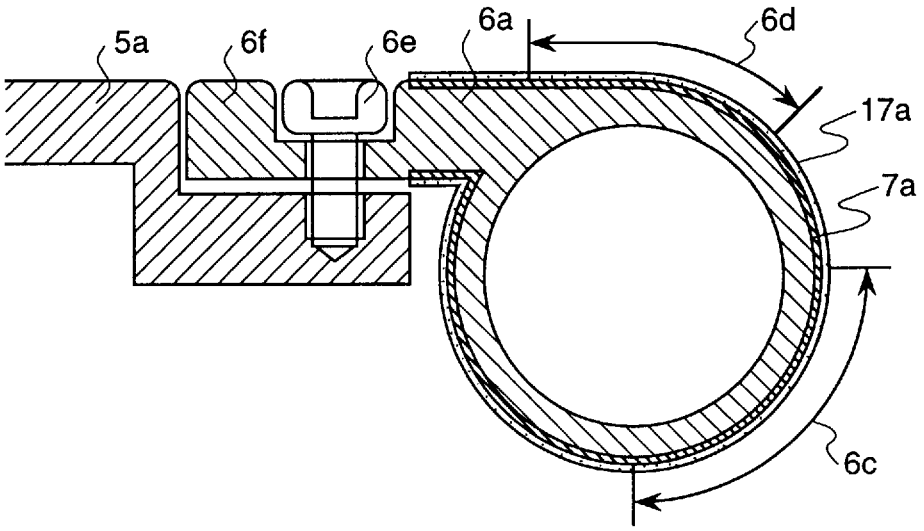
FIG. 4 is a cross section showing the structure of the shield enclosing the interrupter section of the gas circuit breaker of this invention and an oxide layer of the shield.
Figure 5:
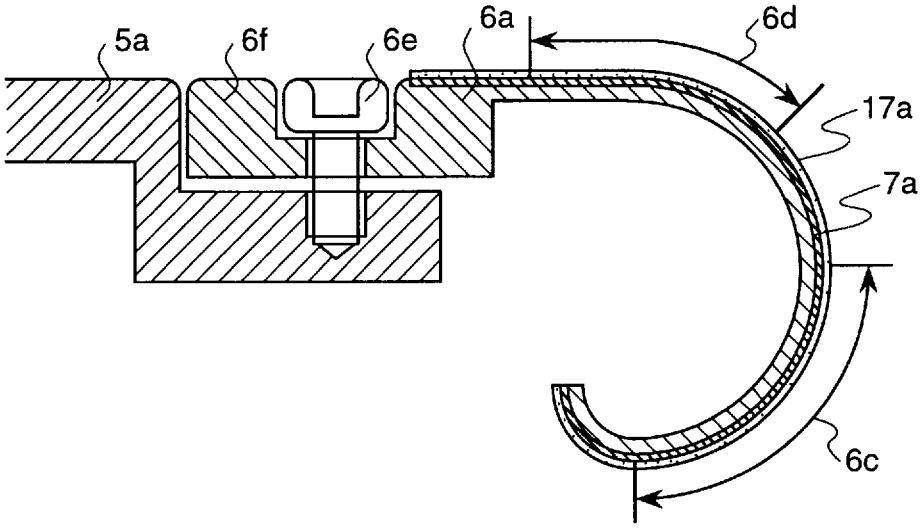
FIG. 5 is a cross section showing the structure of the shield enclosing the interrupter section of the circuit breaker of this embodiment and an oxide layer of the shield.

Next, the portion of the shield which is subjected to surface treatment is explained by referring to FIG. 4 and 5. These figures show the structure of the shield enclosing the interrupter section of the circuit breaker of this embodiment and also the layers formed over the shield. FIG. 4 represents an example structure of the shield made of a pipe material, and FIG. 5 represents an example structure fabricated by drawing.

The shield 6*a* of FIGS. 4 and 5 has two areas where the electric field is high. The electric field of a part 6*c* is related to the pole-to-pole dielectric strength and an improvement of the dielectric strength of this part leads to an improvement of the dielectric strength of this part leads to an improvement of the pole-to-pole dielectric strength. The detail of this mechanism has been described above. The electric field of a part 6*d* is related to the dielectric strength between the contacts and the ground and an improvement of this dielectric strength contributes to an improvement in the shield's dielectric strength to the ground, allowing a reduction in the diameter of the metal container 10. Hence, the portion where the oxide layer 7*a* is formed needs to include the high-electric-field portions 6*c*, 6*d*.

In FIGS. 4 and 5, the portion 6*a* that needs a surface treatment is fabricated separately from the cylindrical shield 5*a*, and is covered with surface layers before assembly. By separately making the part that requires surface treatment in this way, the size of the electrolytic cell for the surface treatment is reduced. During assembly, the part 6*a* is secured to the cylindrical shield 5*a* by bolts 6*e* and a mounting portion 6*f* of the part 6*a* needs to be electrically connected to the shield 5*a*, so that the mounting portion 6*f* is masked during the oxidation processing.

Figure 6:
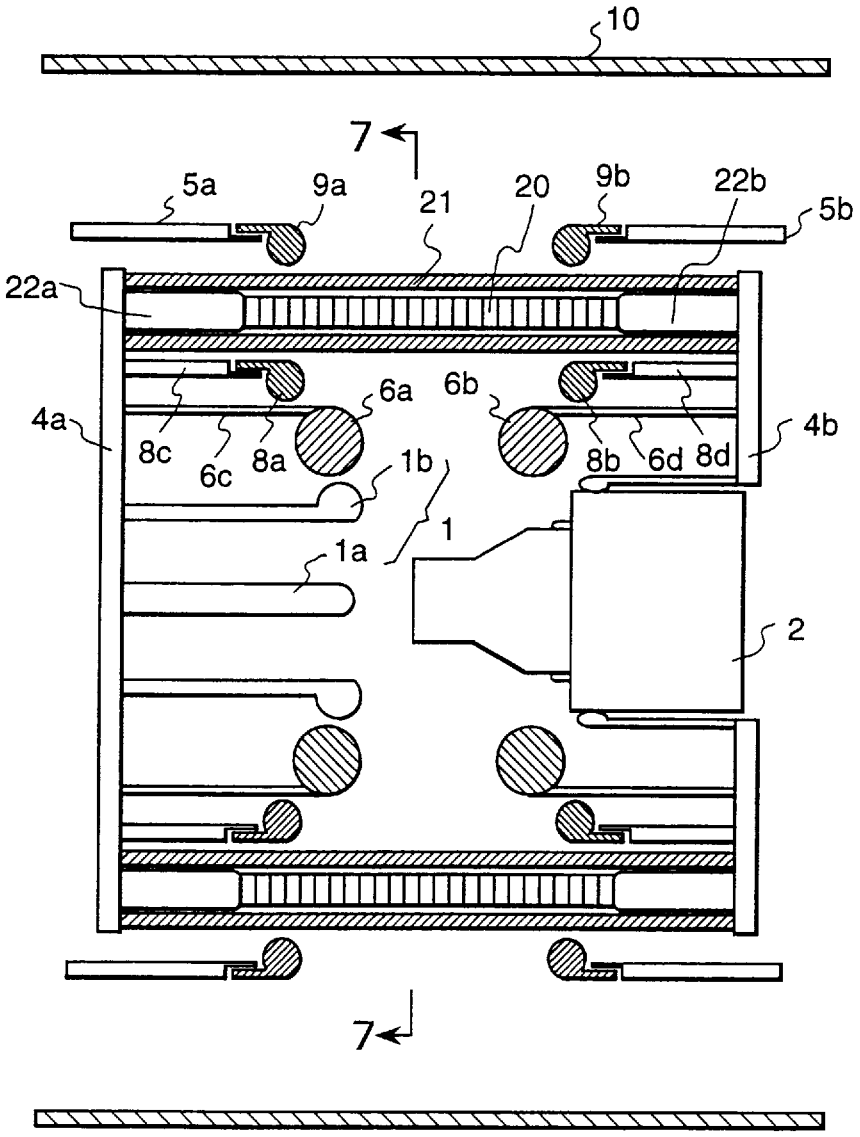
FIG. 6 is a cross section of an embodiment in which a capacitor is installed between poles of the interrupter section.
Figure 7:
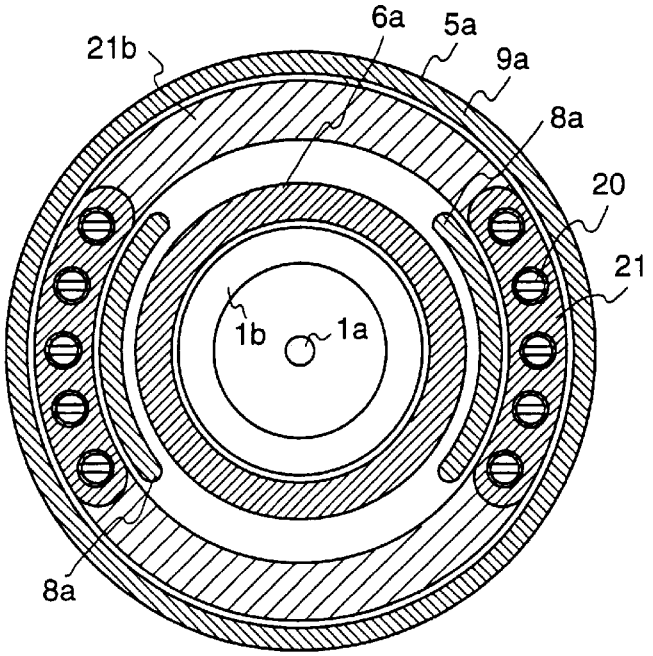
FIG. 7 is a cross section taken along the line B—B' of FIG. 2.

FIG. 6 shows one embodiment in which a capacitor is inserted in parallel with and between the electrodes in the interrupter section. FIG. 7 is a cross section of the gas circuit breaker taken along the line B–B' of FIG. 6. In the gas circuit breaker of FIG. 6, capacitor shields 8*a*, 8*b*, 9*a*, 9*b* are provided for improving the dielectric strength of the capacitor. The shields 9*a*, 9*b* are generally mounted to cylindrical shields 5*a*, 5*b*, respectively. The shields 8*a*, 8*b* are secured to conductors 4*a*, 4*b* through support fittings 8*c*, 8*d*.

These capacitor shields 8*a*, 8*b*, 9*a*, 9*b* have high electric fields at their front ends as the shields 6*a*, 6*b* do. Thus, the surface treatment described above improves the dielectric strength and realizes reduction in the size and cost of the circuit breaker.

Figure 8:
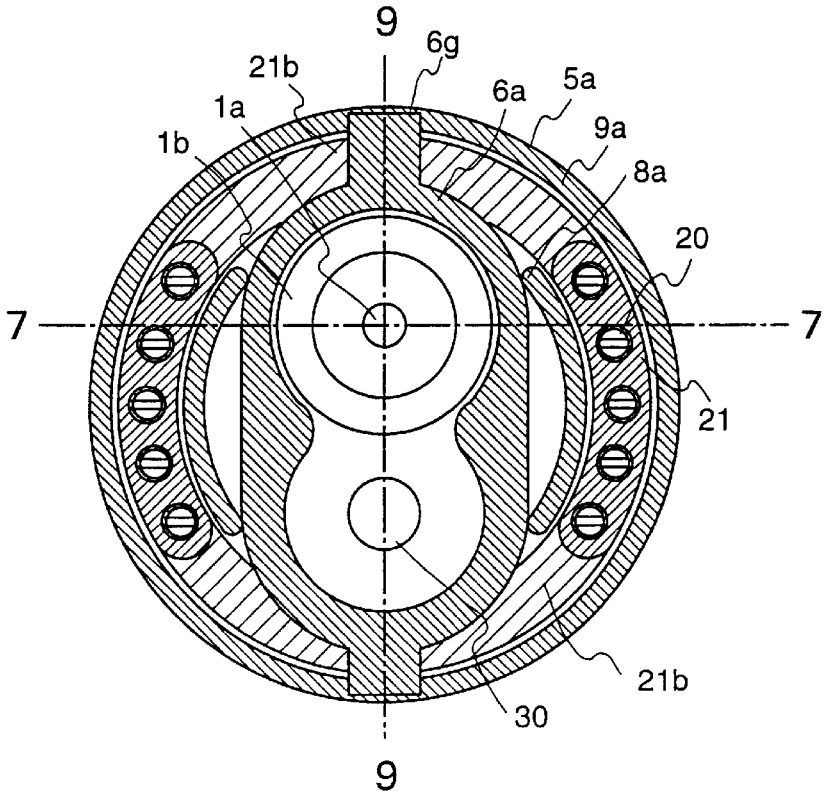
FIG. 8 is a lateral cross section of another embodiment of the gas circuit breaker of this invention.

FIG. 8 shows one embodiment of the circuit breaker having a closing resistor contact 30. In the circuit breaker of FIG. 8, the B–B' cross section is similar to the structure of FIG. 6 and also has the similar surface treatment to what was described referring to FIG. 6.

Figure 9:
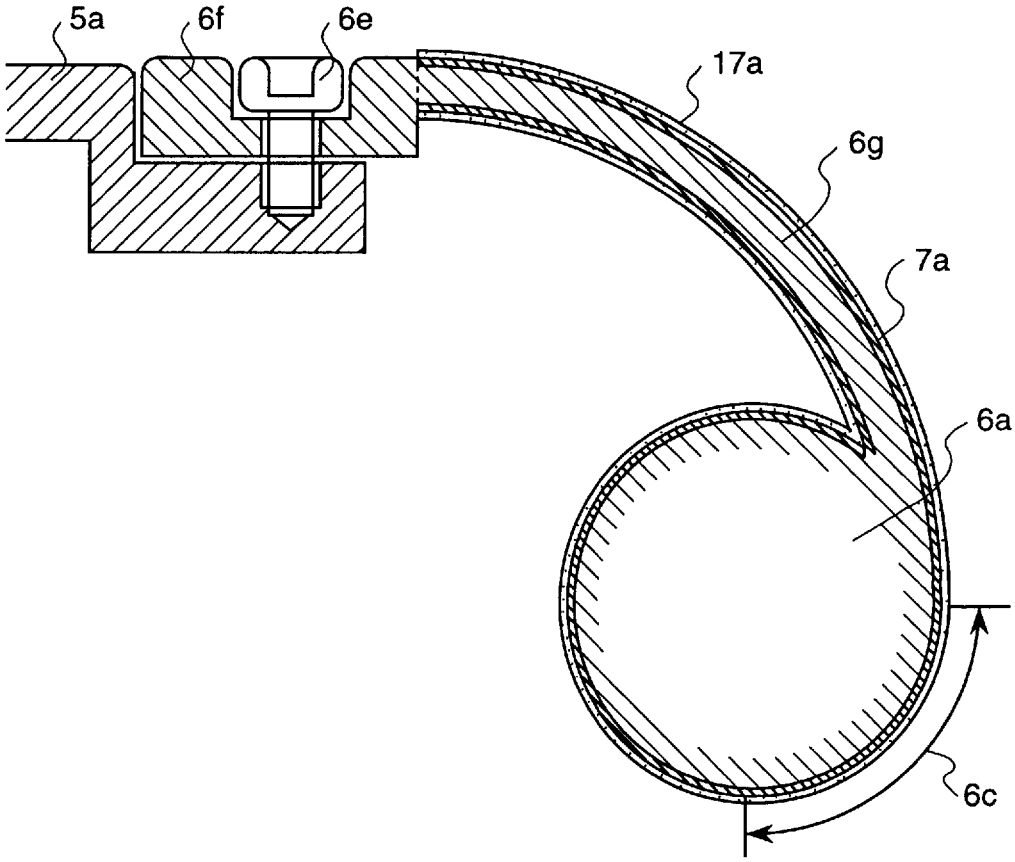
FIG. 9 is a cross section of the shield enclosing the interrupter section of FIG. 8, taken along the line C–C'.

Because the closing resistor contact 30 is provided, the roughly annular shields 6*a*, 6*b* are deformed to enclose the closing resistor contact 30. A shield mounting portion 6*g* is connected to the cylindrical shield 5*a* to support the shields 6*a*, 6*b*. The detail of the portion of the shield 6*a* is as shown in FIG. 9, for example.

This construction makes it possible to easily mount the shields 6*a*, 6*g* after the assembly of other parts of the interrupter section is finished. This improves the workability of the shields, and eliminates the possibility of scarring the shield surface during assembly decreases, so that the reliability also improves.

As described above, the gas circuit breaker of the above construction can improve the dielectric strength between the two opposing contacts and also the dielectric strength between the contacts and the ground. This in turn reduces the pole-to-pole distance and therefore the size of the interrupter section. At the same time, because the stroke of the movable contact 2 is reduced, the operating device can also be made small. The metal container therefore can be reduced in diameter.

This invention can thus provide a gas circuit breaker of this kind, whose shield is protected against flaking and damages when subjected to mechanical impacts and can maintain high dielectric strength without increasing the size of the circuit breaker.

What is claimed is:

1. A gas circuit breaker comprising:

a metal container filled with an insulating gas;

first and second contact disposed opposite each other in the metal container so that they can be brought into and out of engagement with each other; and a metal shield arranged in the metal container to enclose the two contacts;

wherein a part or a whole of a surface of the shield is oxidized and covered with a fluororesin layer.

2. A gas circuit breaker according to claim 1, wherein the fluororesin layer contains boron nitride.

3. A gas circuit breaker according to claim 1, wherein the oxide layer has a thickness of 10 $\mu$m to 100 $\mu$m.

4. A gas circuit breaker comprising:

a metal container filled with an insulating gas;

first and second contacts disposed opposite each other in the metal container so that they can be brought into and out of engagement with each other; and a metal shield member arranged in the metal container to enclose the two contacts;

wherein a whole or a part of the shield member is made of aluminum, at least a part of a surface of the aluminum includes an oxide layer covered with a fluororesin layer.

5. A gas circuit breaker according to claim 4, wherein the oxide layer over the surface of the aluminum is formed by anodization.

6. A gas circuit breaker comprising:

a metal container filled with an insulating gas;

first and second contact disposed opposite each other in the metal container so that they can be brought into and out of engagement with each other;

a capacitor arranged between and in parallel with the two contacts; and a metal shield arranged in the metal container close to the capacitor to alleviate an electric field of the capacitor;

wherein a surface of the shield includes an oxide layer covered with a fluororesin layer.

7. A gas circuit breaker according to claim 6, wherein the oxide layer has a thickness of 10 $\mu$m to 100 $\mu$m.

8. A gas circuit breaker comprising:

a metal container filled with an insulating gas;

first and second contacts disposed opposite each other in the metal container so that they can be brought into and out of engagement with each other;

a capacitor arranged between and in parallel with the two contacts; and a metal shield arranged in the metal container close to the capacitor to alleviate an electric field of the capacitor;

wherein an oxide layer is provided to a front end of the shield and an area surrounding the front end, and a surface of the oxide layer is covered with a fluororesin layer containing boron nitride.

* * * * *